US008531095B2

(12) United States Patent
Ban et al.

(10) Patent No.: US 8,531,095 B2
(45) Date of Patent: Sep. 10, 2013

(54) SPARK PLUG COMPRISING ENHANCED CONTAMINATION-RESISTING AND HEAT-RESISTING PROPERTIES

(75) Inventors: Kenji Ban, Gifu (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 14 days.

(21) Appl. No.: 13/393,718

(22) PCT Filed: Jul. 12, 2010

(86) PCT No.: PCT/JP2010/004499
§ 371 (c)(1),
(2), (4) Date: Mar. 1, 2012

(87) PCT Pub. No.: WO2011/027500
PCT Pub. Date: Mar. 10, 2011

(65) Prior Publication Data

US 2012/0161605 A1 Jun. 28, 2012

(30) Foreign Application Priority Data

Sep. 2, 2009 (JP) ..... 2009-202381

(51) Int. Cl.
*H01T 13/20* (2006.01)

(52) U.S. Cl.
USPC ..... 313/143; 313/141; 313/137

(58) Field of Classification Search
USPC ..... 313/118–145; 123/169 R, 169 EL, 123/32, 41, 310
See application file for complete search history.

(56) References Cited

U.S. PATENT DOCUMENTS

2003/0122462 A1* 7/2003 Nishikawa et al. ..... 313/143
2005/0057135 A1* 3/2005 Yoshimoto et al. ..... 313/141

(Continued)

FOREIGN PATENT DOCUMENTS

EP 2190084 A1 * 5/2010
JP 2005-183177 A 7/2005

(Continued)

OTHER PUBLICATIONS

International Search Report (PCT/ISA/210) issued Oct. 12, 2010 in International Application No. PCT/JP2010/004499.
Written Opinion (PCT/ISA/237) issued Oct. 12, 2010 in International Application No.PCT/JP2010/004499.

*Primary Examiner* — Anne Hines
*Assistant Examiner* — Jose M Diaz
(74) *Attorney, Agent, or Firm* — Sughrue Mion, PLLC

(57) ABSTRACT

In a spark plug that has a small sized center electrode, enhancement of corruption-resisting property and heat-resisting property is promoted. The spark plug 1 includes a center electrode 5, an insulator 2 and a metal shell 3, and the insulator 2 includes a foot section 13, a tapered section 14 and a middle body section 12. The maximum outer diameter of a portion, which is arranged within the foot section 13, of the center electrode 5 becomes 3.0 mm or less. A step section 21 and a leading end side inner periphery section 51 are formed in the inner periphery of the metal shell 3 and the tapered section 14 is engaged to a step section 21. When A ($mm^3$) is a volume of a portion of 2 mm of the insulator 2 from leading end of the insulator 2 toward the rear end side along the axis CL1 and B ($mm^3$) is a volume of a portion of the tapered section 2 from the rear end of the portion of the tapered section 14 which is engaged to the step section 21 to the leading end side and the portion is 1.5 mm or less of the diameter difference between the leading end side inner periphery section 51 and its outer periphery portion, $0.12 \leqq A/B \leqq 0.24$ is satisfied.

8 Claims, 5 Drawing Sheets

(56) References Cited

U.S. PATENT DOCUMENTS

| | | | | |
|---|---|---|---|---|
| 2006/0028108 | A1 | 2/2006 | Okabe et al. | |
| 2007/0126330 | A1 | 6/2007 | Kuki et al. | |
| 2011/0000453 | A1* | 1/2011 | Kuribayashi et al. | 123/169 R |
| 2011/0017163 | A1* | 1/2011 | Suzuki et al. | 123/169 E |
| 2012/0262049 | A1* | 10/2012 | Kurono et al. | 313/141 |

FOREIGN PATENT DOCUMENTS

| | | | |
|---|---|---|---|
| JP | 2006-49207 | A | 2/2006 |
| WO | WO 2009/034989 | A1 | 3/2009 |

* cited by examiner

SPARK PLUG COMPRISING ENHANCED CONTAMINATION-RESISTING AND HEAT-RESISTING PROPERTIES

TECHNICAL FIELD

The present invention relates to a spark plug that is used in an internal combustion engine or the like.

BACKGROUND ART

The spark plug is attached to a combustion apparatus in the internal combustion engine or the like and used to ignite an air/fuel mixture within a combustion chamber. Generally, the spark plug includes an insulating body that has an axial hole, a center electrode that passes through the axial hole, a metal shell that is arranged at the outer periphery of the insulating body and a ground electrode that is arranged at a leading end surface of the metal shell and forms a spark discharge gap with the center electrode. Also, when the metal shell and the insulating body are assembled, generally a step section that is arranged at the inner periphery surface of the metal shell and a tapered section that is arranged at the outer periphery surface of the insulating body are engaged through a metal sheet packing.

However, carbon is generated by an incomplete combustion of the air/fuel mixture in the combustion chamber and there is concern that the carbon will be deposited on the surface of the insulating body. When the carbon deposit advances to the surface of the insulating body, the leading end section surface of the insulating body is covered by carbon and then contaminated, and there is concern that a normal spark discharge may not be generated in the spark discharge gap and electric current may flow (leak) via carbon to the metal shell from the center electrode.

Meanwhile, a spark plug, which has a function of burning and eliminating the carbon, in other words a "self-cleaning function", is known in which a surface temperature of the insulating body is raised rapidly in order to enhance a contamination-resisting property.

However, when the temperature of the leading end of the spark plug is excessively heated above a predetermined temperature (for example, 1100° C.), there is concern that the overheated leading end of the spark plug becomes a spark source. In other words, the air/fuel mixture is ignited, in other words, "pre-ignition" is randomly generated even before ignition of the spark plug.

Accordingly, a technique has been proposed in which the gap between the portion that is positioned at the leading end side of the tapered section and the metal shell is small and a length along an axis of the gap is large (for example, see Patent document 1). In the technique, the gap is small so that the heat is controlled, so as to be effectively transferred toward the metal shell from the insulating body and enhancement of heat-resisting property is promoted. Also, the length along the axis of the gap is large so that inflow of unburned gas (carbon) toward the gap is prevented and enhancement of the corruption-resisting property is promoted.

RELATED ART DOCUMENT

Patent Document

[Patent document 1] Japanese Patent Publication No. 2005-183177-A

SUMMARY OF INVENTION

Problem that the Invention is to Solve

However, while both the heat-resisting property and the contamination-resisting property can be enhanced to some degree, there is concern that the advance of contamination and the leakage of current are generated by using the combustion apparatus.

Recently, there has been a demand for a reduction in the size of the spark plug and a reduction in the size of the insulating body. In the smaller insulating body, the thickness of the insulating body is required to be sufficiently secured so as to secure the voltage-resisting property, as a result of the axial hole of the insulating body being reduced in size. At this time, even the center electrode that is passed through the axial hole is also reduced in size, however heat of the insulating body is drawn mainly to the metal shell from the center electrode that is excellent in heat conductivity. Thus, in accordance with the reduction in size of the center electrode, there is concern that the efficiency of the heat transfer from the insulating body to the metal shell is lowered and the heat-resisting property of the insulating body is lowered.

An advantage of some aspects of the invention is to provide a spark plug having a center electrode reduced in size wherein both the contamination-resisting property and the heat-resisting property are enhanced.

Means for Solving the Problem

Hereinafter, each of the configurations that are applied to solve the above-described problems will be described in each of the sections.

Configuration 1

A spark plug comprising: a rod shape center electrode; a cylindrical shape insulating body that has an axial hole extending in an axis direction and includes the center electrode at a leading end side of the axial hole; and a cylindrical shape metal shell that surrounds and holds a periphery of the insulating body in a state that a leading end section of the insulating body is extended further than its leading end surface, wherein the insulating body includes: a foot section that is positioned at the leading end section; a tapered section that is extended toward a rear end side from a rear end of the foot section and has a diameter that is widened toward the rear end side; and a middle body section that is extended toward the rear end side from a rear end of the tapered section and has a diameter that is larger than the foot section, wherein a step section and a leading end side inner periphery section that is positioned at a leading end side of the step section are formed in the inner periphery of the metal shell, wherein the insulating body is fixed at the metal shell in a state that the tapered section is directly or indirectly engaged with respect to the step section, wherein a maximum outer diameter of a portion, which is arranged within the foot section, of the center electrode is 3.0 mm or less, wherein assuming that A ($mm^3$) is a volume of a portion of 2 mm of the insulating body from a leading end of the insulating body toward a rear end side along the axis direction and B ($mm^3$) is a volume of a portion of the insulating body from a rear end of the portion of the tapered section which is engaged to the step section to a leading end side and in which a diameter difference between the leading end side inner periphery section and its outer periphery portion is 1.5 mm or less, $0.12 \leqq A/B \leqq 0.24$ is satisfied.

That "a portion of the insulating body from a rear end of the portion of the tapered section which is engaged to the step section to a leading end side and the portion of the difference in diameter between the leading end side inner periphery section and its outer periphery portion is 1.5 mm or less (hereinafter, referred to as "the root section of the insulating body") means an area from between the rear end of the portion that is engaged to the step section of the tapered section to the rear end of the portion in which the difference in diameter between the leading end side inner periphery section and the outer periphery portion of the insulating body is initially just over 1.5 mm further toward the leading end side from the rear end of the engaged portion of the step section of the tapered section than the rear end. Accordingly, even though the portion in which the difference in diameter is 1.5 mm or less is present, at the leading end side from the portion in which the difference in diameter between the leading end side inner periphery section and the outer periphery portion of the insulating body is over 1.5 mm, the portion is not an object of the root section of the insulating body.

Configuration 2

The spark plug according to the configuration 1, wherein the metal shell has a screw section that is screwed into an attachment hole of a combustion apparatus, a screw diameter of the screw section is M14, and 12 $mm^3 \leqq A$ and 83 $mm^3 \leqq B \leqq 113$ $mm^3$ are satisfied.

Also, since the volume B of the root section of the insulating body is 83 $mm^3$ or more, the root section of the insulating body has a sufficient size (thickness) and an excellent voltage-resisting property can be secured in the root section of the insulating body. While, since widening of the diameter of the bore of the metal shell in which the insulating body is passed through is also limited, there is a limit in making the outer diameter of the insulating body large as well. Accordingly, as the second configuration, the volume B of the root section of the insulating body is preferable to 113 $mm^3$ or less in the spark plug of M14 a screw diameter.

Also, the portion in which the difference in diameter between the leading end side inner periphery section of the metal shell and its outer periphery portion becomes 1.5 mm or less is further along the axis so that the volume B of the root section of the insulating body can be also increased. However, in this case, since a portion that has a large gap of some degrees that is present between the inner periphery surfaces of the metal shell in the foot section of the insulating body is relatively decreased, a relatively small amount of carbon is deposited so that there is a concern that the leakage of current will be generated. Accordingly, even taking this point into consideration, the volume B of the root section of the insulating body is preferably 113 $mm^3$ or less.

Configuration 3

The spark plug according to the configuration 2, wherein the maximum outer diameter of the portion, which is arranged within the foot section, of the center electrode is 1.7 mm or more.

Configuration 4

The spark plug according to the configuration 1, wherein the metal shell has a screw section that is screwed into an attachment hole of a combustion apparatus, a screw diameter of the screw section is M12, and 6 $mm^3 \leqq A$ and 35 $mm^3 \leqq B \leqq 54$ $mm^3$ are satisfied.

Also, considering the size or the like of the bore of the metal shell in which the screw diameter is M12, the volume B of the root section of the insulating body is preferably to 54 $mm^3$ or less.

Configuration 5

The spark plug according to the configuration 4, wherein the maximum outer diameter of the portion, which is arranged within the foot section, of the center electrode is 1.5 mm or more to 2.6 mm or less.

Configuration 6

The spark plug according to the configuration 1, wherein the metal shell has a screw section that is screwed into an attachment hole of a combustion apparatus, a screw diameter of the screw section is M10, and 3.5 $mm^3 \leqq A$ and 20 $mm^3 \leqq B \leqq 37$ $mm^3$ are satisfied.

Configuration 7

The spark plug according to the configuration 6, wherein the maximum outer diameter of the portion, which is arranged within the foot section, of the center electrode is 1.3 mm or more to 2.1 mm or less.

Configuration 8

The spark plug according to any one of the configurations 1 to 7, further comprising, a ground electrode that is extended from the leading end section of the metal shell and a leading end section thereof forms a gap with the leading end section of the center electrode, wherein a noble metal tip is arranged in at least one of the center electrode and the ground electrode.

Advantageous Effects of Invention

According to the spark plug of the first configuration, each of the volumes of the leading end section of the insulating body and the root section of the insulating body is set so as to satisfy $0.12 \leqq A/B \leqq 0.24$ assuming that A ($mm^3$) is the volume of the portion of 2 mm (referred to as "leading end section of the insulating body") from the leading end of the insulating body to the rear end side along the axis direction in the insulating body and B ($mm^3$) is the volume of the root section of the insulating body.

Here, the size of the volume of the leading end section of the insulating body shows the temperature rising characteristics of the portion. As the volume of the leading end section of the insulating body is large, it is difficult for the temperature of the portion to rise and to be a high temperature while since the volume of the leading end section of the insulating body is low, it is easy for the temperature of the portion to rise and to be a high temperature.

In the first configuration, considering the elements, $0.12 \leqq A/B$ (in other words, the volume of the leading end section of the insulating body is prevented from being extremely small) so that an excess rise in temperature of the leading end section of the insulating body is prevented and enhancement of the heat-resisting property is promoted. Meanwhile, $A/B \leqq 0.24$ (in other words, the volume of the leading end section of the insulating body is prevented from being extremely large) so that the leading end section of the insulating body can have a relatively high temperature and the enhancement of the contamination-resisting property is promoted when the spark plug is used.

The size of the volume of the root section of the insulating body shows the size of a channel of heat transfer to the metal shell (the combustion apparatus) side from the center electrode that is superior in heat conductivity, in other words, it is easy to draw the heat of the leading end section of the insulating body through the center electrode. According to the first configuration, the volume B of the root section of the insulating body is configured to satisfy $A/0.24 \leqq B \leqq A/0.12$. In other words, according to the volume (the quantity of heat that is contained in the leading end section of the insulating body) of the leading end section of the insulating body, sufficient heat drawing ability can be secured, while the volume of the root section of the insulating body is set to a degree that the heat of the leading end section of the insulating body is not excessively drawn. Thus, the maximum outer diameter of the portion that is arranged within the foot section of the center electrode becomes as relatively small as 3.0 mm or less and even in the spark plug in which there is concern that the heat-resisting property of the insulating body is should be lowered, the volume of the leading end section of the insulating body is set as described above so that enhancement of the heat-resisting property and the contamination-resisting property can be reliably and effectively promoted further without damage to the operation effect in which the heat-resisting property and the contamination-resisting property are enhanced.

According to the spark plug of the second configuration, in the spark plug in which the screw diameter of the screw section is M14, the volume A of the leading end section of the insulating body is 12 $mm^3$ or more. Thus, the leading end section of the insulating body has a sufficient size (thickness) and the voltage-resisting property can be sufficiently maintained in the leading end section of the insulating body.

According to the spark plug of the third configuration, the maximum outer diameter of the portion that is arranged within the foot section of the center electrode is 1.7 mm or more. Thus, even in the case that the screw diameter of the screw section is M14 and the volume of the leading end section of the insulating body is relatively large, the heat of the leading end section of the insulating body or the leading end section of the center electrode can effectively transfer to the metal shell side through the center electrode. As a result, enhancement of the heat-resisting property can be further promoted.

According to the spark plug of the fourth configuration, in the spark plug in which the screw diameter of the screw section is M12, the volume A of the leading end section of the insulating body is 6 $mm^3$ or more. Thus, the thickness of the leading end section of the insulating body becomes a sufficient size and the voltage-resisting property can be sufficiently maintained in the leading end section of the insulating body. Furthermore, since the volume B of the root section of the insulating body becomes 35 $mm^3$ or more, an excellent voltage-resisting property can be promoted even in the root section of the insulating body.

According to the spark plug of the fifth configuration, since the maximum outer diameter of the portion that is arranged within the foot section in the center electrode is 1.5 mm or more corresponding to the size of the leading end section of the insulating body when the screw diameter is M12, the heat of the leading end section of the insulating body or the leading end section of the center electrode can effectively transfer to the metal shell and the enhancement of the heat-resisting property can be further promoted. Meanwhile, since the maximum outer diameter of the portion that is arranged within the foot section in the center electrode is 2.6 mm or less, the thinning of the insulating body can be prevented and the enhancement of the voltage-resisting property can be further promoted.

According to the spark plug of the sixth configuration, in the spark plug in which the screw diameter of the screw section is M10, an excellent voltage-resisting property can be realized in both the leading end section of the insulating body and the root section of the insulating body.

According to the spark plug of the seventh configuration, in the spark plug in which the screw diameter of the screw section is M10, enhancement of the heat-resisting property and the voltage-resisting property can be further promoted.

According to the spark plug of the eighth configuration, since the noble metal tip is welded to at least any one side of the center electrode and the ground electrode, the a wear-resisting property can be enhanced and long lifespan can be promoted.

DESCRIPTION OF EMBODIMENTS

Figure 1:
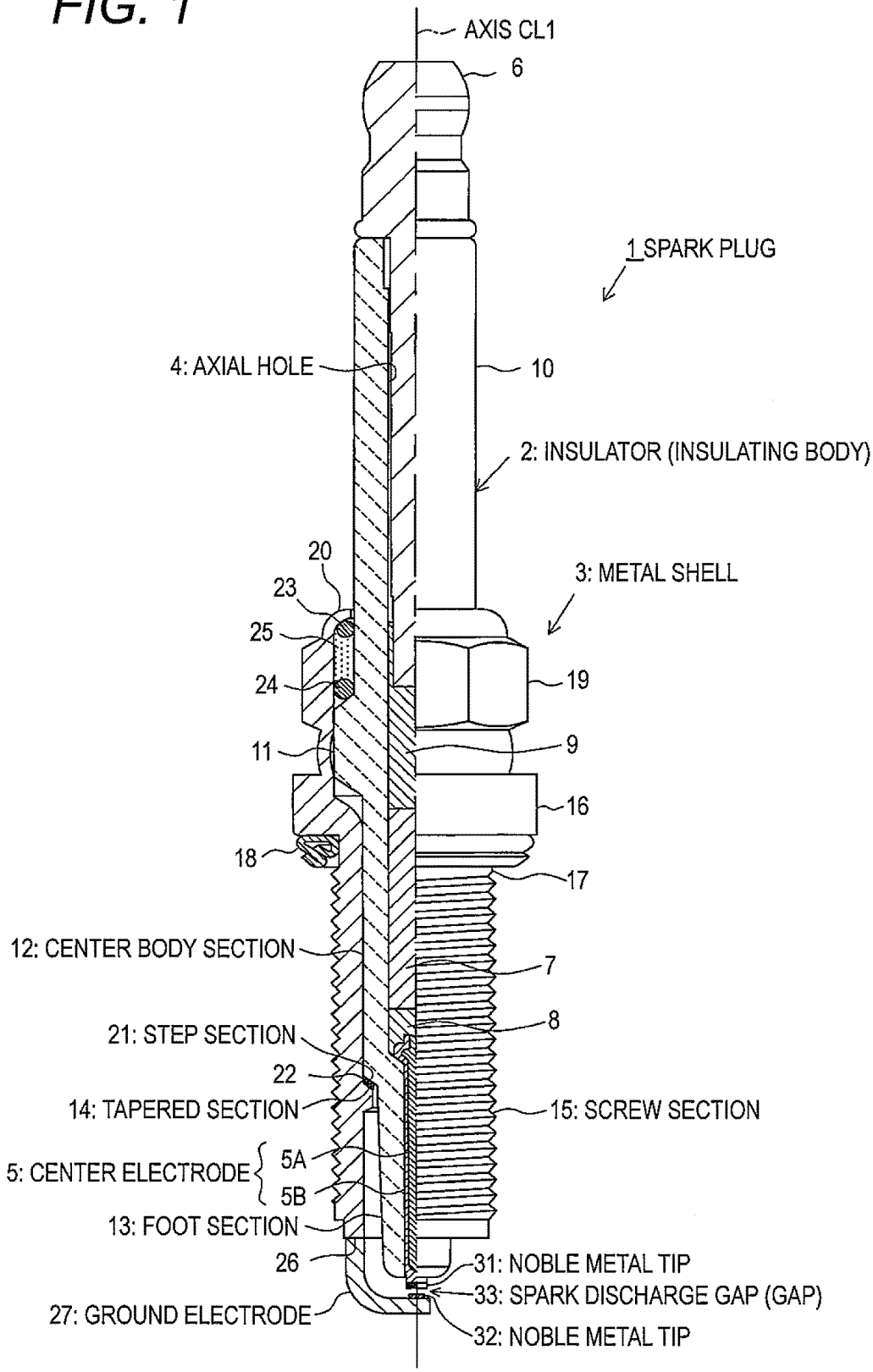
FIG. 1 is a plan view as a portion being broken out illustrating a configuration of a spark plug.

Hereinafter, an embodiment will be described with reference to drawings. FIG. 1 is a plan view as a portion being broken out illustrating a configuration of a spark plug 1. In FIG. 1, description will be given, as an axis CIA direction of the spark plug 1 is a vertical direction in drawings and the lower side is a leading end side of the spark plug 1 and the upper side is a rear end side.

The spark plug 1 is configured by an insulator 2 that has a cylindrical shape as an insulating body and a cylindrical shape metal shell 3 that holds the insulator 2.

The insulator 2 is formed as burnt alumina or the like known in the art, and includes a rear end side body section 10 that is formed at the rear end side in the outer shape section, a large diameter section 11 that is projected and formed to the outside in a diametrical direction in the further leading end side than the rear end side body section 10, a middle body section 12 that is formed in a diameter thinner than the large diameter section 11 in the leading end side and a foot section 13 that is formed in a diameter thinner than the middle body section 12 in the leading end side. Additionally, the large diameter section 11, the middle body section 12 and most of the foot section 13 of the insulator 2 is accommodated into the inside of the metal shell 3. Also, a tapered section 14 is formed at a connecting section of the foot section 13 and the middle body section 12, and an insulator 2 is engaged to the metal shell 3 at the tapered section 14.

Furthermore, an axial hole 4 is formed at the insulator 2 along the axis CL1 and a center electrode 5 is inserted and fixed to the leading end side of the axial hole 4. The center electrode 5 is configured by an inner layer 5A that includes copper or cooper alloy and an outer layer 5B that includes Ni alloy composed of nickel (Ni) as a main composition. Also, the center electrode 5 has a rod shape (circular cylindrical shape) entirely, the leading end surface is a planar shape and is projected from the leading end of the insulator 2. Furthermore, a noble metal tip 31 that is circular cylindrical shape formed by noble metal alloy (for example, iridium alloy) is welded at the leading end section of the center electrode 5.

Also, a terminal electrode 6 is inserted and fixed into the rear end side of the axial hole 4 in a state of projecting from the rear end of the insulator 2.

Furthermore, a circular cylindrical shape resistor 7 is arranged in the axial hole 4 between the center electrode 5 and the terminal electrode 6. Both end sections of the resistor 7 are electrically connected to the center electrode 5 and the terminal electrode 6 through glass seal layers 8 and 9 having conductivity, respectively.

Additionally, the metal shell 3 is formed in cylindrical shape by a metal such as low carbon steel and a screw section (a male screw) 15 is formed at the outer periphery surface so as to attach the spark plug 1 to a combustion apparatus such as an internal combustion engine. Also, a seat section 16 is formed at the outer periphery surface of the rear end side of the screw section 15 and a ring shape gasket 18 is inserted in a screw head 17 of the rear end of the screw section 15. Furthermore, a tool engaging section 19 of a hexagonal shape in cross section that engages a tool such as a wrench when the spark plug 1 is attached to the combustion apparatus is arranged at the rear end side of the metal shell 3. A clamping section 20 is arranged at the rear end section to hold the insulator 2.

Also, a tapered shape step section 21 is arranged at the inner periphery surface of the metal shell 3 to engage the insulator 2. Thus, the insulator 2 is inserted to the leading end side from the rear end side of the metal shell 3 and clamps an opening of the rear end side of the metal shell 3 into the inside in the diametrical direction in a state such that its tapered section 14 is engaged to the step section 21 of the metal shell 3, in other words, the insulator 2 is fixed by forming the clamping section 20. Also, circular shape sheet packing 22 is accommodated between the tapered section 14 of the insulator 2 and the step section 21 of the metal shell 3. Accordingly, sealability within the combustion chamber is maintained and an air/fuel mixture that enters into a gap between the foot section 13 of the insulator 2 that is exposed in the combustion chamber and the inner periphery surface of the metal shell 3 is not leaked to the outside.

Furthermore, circular shape ring members 23 and 24 are inserted between the metal shell 3 and the insulator 2, and powder of talc (talcum) 25 is charged between the ring members 23 and 24 at the rear end side of the metal shell 3 so that the seal by clamping is further completed. In other words, the metal shell 3 holds the insulator 2 through the sheet packing 22, the ring members 23 and 24 and the talc 25.

Also, a ground electrode 27 is welded to the leading end section 26 of the metal shell 3 wherein the ground electrode 27 is bent in the middle thereof and the side surface is opposite to the leading end section of the center electrode 5. In the ground electrode 27, a noble metal tip 32 that is composed of noble metal alloy (for example, platinum alloy) is welded to a portion that is opposite to the leading end section (a noble metal tip 31) of the center electrode 5. Thus, a spark discharge gap 33 is formed between the noble metal tips 31 and 32 as a gap and a spark discharge is performed in a direction substantially along the axis CL1 in the spark discharge gap 33.

Meanwhile, in the embodiment, the screw diameter of the screw section 15 of the metal shell 3 is M14. Thus, inner diameter of an inner hole of the metal shell to which the insulator 2 is inserted has a size that is matched with a size of the screw section 15 and a size (outer diameter) of the insulator 2 or a inner diameter of the axial hole 4 of the insulator 2 is set corresponding to the size of the inner hole of the metal shell 3. Thus, in the embodiment, a maximum outer diameter of a portion that is arranged within the foot section 13 in the center electrode 5 is 1.7 mm to 3.0 mm that matches the inner diameter of the axial hole 4 of the insulator 2.

Figure 2:
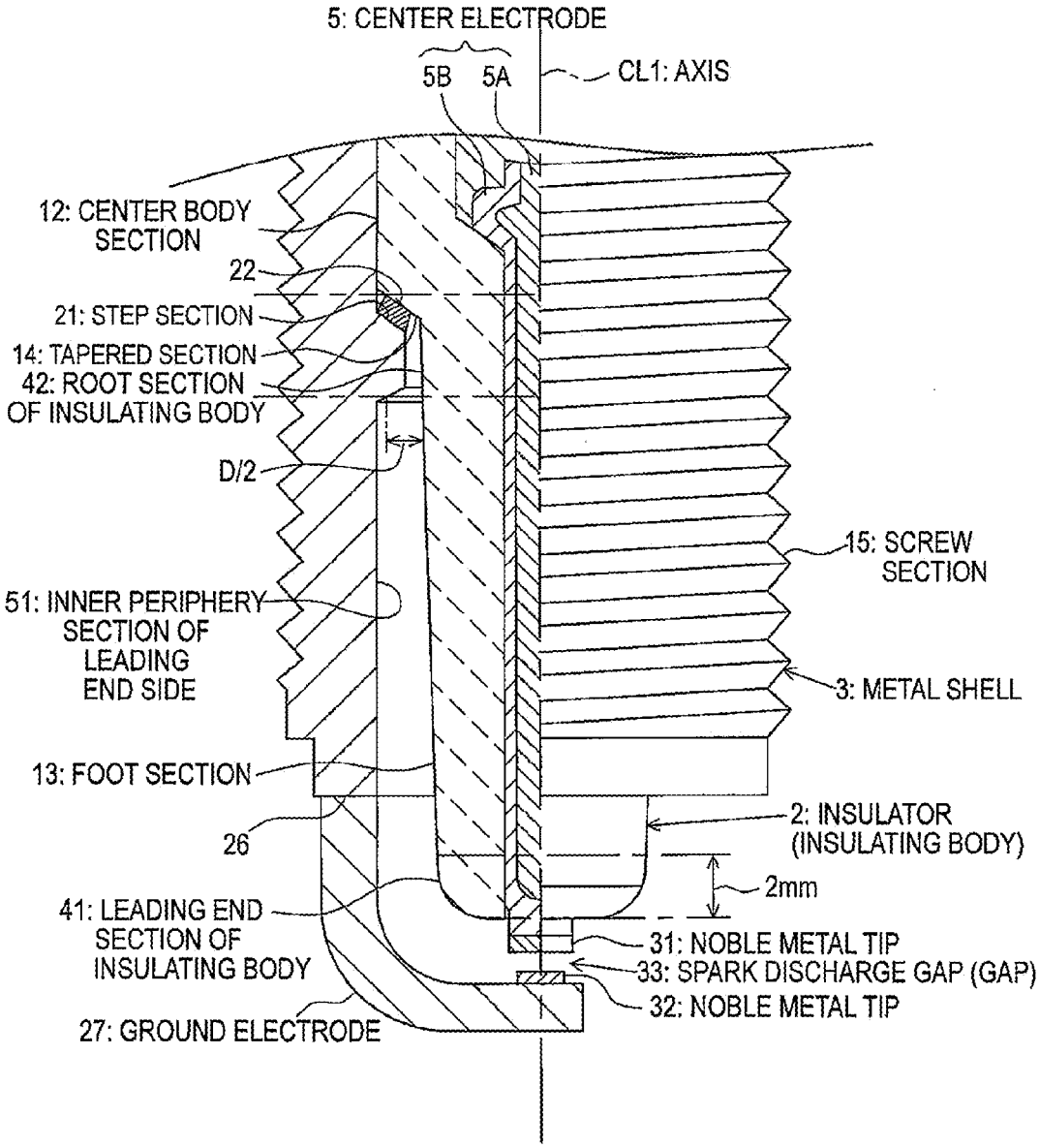
FIG. 2 is an enlarged plan view as a portion being broken out illustrating a configuration of a leading end section of a spark plug.

Additionally, as shown in FIG. 2, a shape or the like of a leading end section 41 of the insulating body is set so as to satisfy $A \geqq 12\ mm^3$, when a volume of a portion 41 (hereinafter, "the insulating body leading end section") from the leading end to 2 mm toward rear end side of the insulator 2 along the axis CL1 direction in the insulator 2 is assumed A.

Meanwhile, in the insulator 2, the leading end side inner periphery section 51 is positioned further leading end side than the step section 21 in the inner periphery of the metal shell 3 that is a portion positioned to the leading end side from a rear end of an engaged portion to the step section 21 (the sheet packing 22) in the tapered section 14. An outer diameter or the like of the root section 42 of the insulating body is set so as to satisfy $83\ mm^3 \leqq B \leqq 113\ mm^3$ when a volume of a portion 42 (hereinafter, referred to as "the root section of the insulating body") in which a diameter of a leading end side inner periphery section 51 is 1.5 mm or less (in other words, $D/2 \leqq 0.75$ mm).

Also, regarding a volume A of the leading end section 41 of the insulating body and a volume B of the root section 42 of the insulating body, volumes A and B are set so as to satisfy $0.12 \leqq A/B \leqq 0.24$.

Also, the numerical value range of the volume A of the leading end section 41 of the insulating body and the volume B of the root section 42 of the insulating body is in a case such that the screw diameter of the screw section 15 becomes M14, the range is also changed by the screw diameter of the screw section 15 is changed.

In other words, in a case such that the screw diameter of the screw section 15 becomes M12, regarding the volume A of the leading end section 41 of the insulating body and the volume B of the root section 42 of the insulating body, $A \geqq 6\ mm^3$ and $35\ mm^3 \leqq B \leqq 54\ mm^3$ respectively. Also, according to the small size diameter of the screw section 15, the insulator 2 and the center electrode 5 that is inserted into the insulator 2 are also to be a small diameter. Thus, in a case such that the screw diameter of the screw section 15 becomes M12, the maximum outer diameter of a portion that is arranged within the foot section 13 in the center electrode 5 becomes 1.5 mm to 2.6 mm.

Also, in a case such that the screw diameter of the screw section 15 becomes M10, regarding the volume A of the leading end section 41 of the insulating body and the volume B of the root section 42 of the insulating body, $A \geqq 3.5\ mm^3$ and $20\ mm^3 \leqq B \leqq 37\ mm^3$ respectively. Additionally, in a case such that the screw diameter of the screw section 15 becomes M10, the maximum outer diameter of a portion that is arranged within the foot section 13 in the center electrode 5 becomes 1.3 mm to 2.1 mm.

However, even though the screw diameter of the screw section 15 is variously changed, regarding A/B, $0.12 \leqq A/B \leqq 0.24$ is satisfied.

Next, a method of manufacturing the spark plug 1 that has the above-described configuration will be described.

First, the metal shell 3 is machined beforehand. In other words, a circular cylindrical shape metal material (for example, iron base material and stainless material such as 17C and S25C) is cold forging processed and forms a penetrating hole and an outlined shape is manufactured. After that, the exterior is arranged by performing a grind process and a metal shell middle body is obtained.

Next, the straight rod shape ground electrode 27 composed of Ni alloy is resistance welded to the leading end surface of the metal shell middle body. When welding is performed, so-called "sagging" is generated. After removing the "sagging", the screw section 15 is formed by roll forming at a predetermined portion of the metal shell middle body. Thus, the metal shell 3 that is welded to the ground electrode 27 is obtained. Also, zinc plating or nickel plating is performed at the metal shell 3 that is welded to the ground electrode 27. Also, chromating may be further performed on the surface so as to enhance corrosion resistance. After the plating is processed, the plating of the leading end section of the ground electrode 27 is removed.

Meanwhile, the insulator 2 is molding processed independently to the metal shell 3. For example, base material for molding is manufactured using raw material powder including alumina as a main composition, binder and the like so that the cylindrical shape molding is obtained by performing a rubber press molding using base material for molding. Also, the axial hole 4 of the insulator 2 in which the center electrode 5 is inserted is formed by the rubber press molding, in a state in which a press pin having a rod shape (a needle shape) is inserted in the base material for molding. Thus, the outer diameter of the press pin is changed according to the size of the center electrode 5 that is passed through the axial hole 4 or the volume of the insulator 2.

Also, a polishing process is performed with respect to the obtained molded article and the exterior shape is arranged. At this time, the polishing process is performed to the molded article so that the volume A of the leading end section 41 of the insulating body or the volume B of the root section 42 of the insulating body becomes above the described numerical value range after a burning process is performed as described below. Next, the burning process is performed after the polishing process and then the insulator 2 is obtained.

Also, the center electrode 5 is prepared independently of the metal shell 3 and the insulator 2. In other words, Ni alloy in which copper alloy for enhancing a heat dissipating at the center portion is forged forming so that the center electrode 5 is manufactured. Next, the noble metal tip 31 is welded to the leading end section of the center electrode 5 by laser welding or the like.

Thus, the insulator 2, the center electrode 5, the resistor 7 and the terminal electrode 6 that are prepared as described above are sealed and fixed by glass seal layers 8 and 9. The glass seal layers 8 and 9 are generally prepared by mixing borosilicate glass and metal powder. Furthermore, the glass seal layers 8 and 9 are burnt and fixed in a burning furnace in a state that the terminal electrode 6 is biased from rear side after the glass seal layers 8 and 9 are inserted into the axial hole 4 of the insulator 2 such that the resistor 7 is interposed between the glass seal layer 8 and the glass seal layer 9. Also, at this time, an enamel layer may be also burnt at the surface of the rear end side body section 10 of the insulator 2 and the enamel layer may be formed beforehand.

After that, the insulator 2 that includes the center electrode 5 and the terminal electrode 6 that are prepared as described above, and the metal shell 3 that includes the ground electrode 27 are assembled together. More specifically, the opening of the rear end side of the metal shell 3 that is formed as relatively thin is clamped to the inside in the diametrical direction, in other words, the insulator 2 and the metal shell 3 are fixed by forming the clamping section 20.

At this time, the insulator 2 and the metal shell 3 are assembled so that the leading end of the insulator 2 is positioned 1.5 mm~3.5 mm to leading end side along the axis CL1 from leading end surface of the metal shell 3.

Next, the noble metal tip 32 is resistance welded or the like to the leading end section of the ground electrode 27 that removes plating. Last, substantially the middle section of the ground electrode 27 is bent, the size of the spark discharge gap 33 is adjusted and machined so that the above described spark plug 1 is obtained.

As described above, according to the embodiment, $0.12 \leqq A/B$ (in other words, the volume A of the leading end section 41 of the insulating body is prevented from being extremely small) so that excessive increases in the temperature of the leading end section 41 of the insulating body are prevented and durability can be enhanced. Meanwhile, $A/B \leqq 0.24$ (in other words, the volume A of the leading end section 41 of the insulating body is prevented from being extremely increased) so that the leading end section 41 of the insulating body can be at a relatively high temperature when the leading end section 41 of the insulating body is used and contamination-resisting property is enhanced.

The size of the volume B of the root section 42 of the insulating body represents the size of a channel of heat delivery to the metal shell 3 (the combustion apparatus) side from the center electrode 5 that is superior in heat conductivity, in other words, it is easy to draw the heat of the leading end section 41 of the insulating body through the center electrode 5. According to the embodiment, the volume B of the root section of the insulating body is configured to satisfy $A/0.24 \leqq B \leqq A/0.12$. In other words, the heat drawing ability can be sufficiently secured according to the volume A (the quantity of heat that is resided in the leading end section 41 of the insulating body) of the leading end section 41 of the insulating body, while the volume B of the root section 42 of the insulating body is set to a degree that the heat of the leading end section 41 of the insulating body is not excessively drawn. Thus, the maximum outer diameter of the portion that is arranged within the foot section 13 of the center electrode 5 is 3.0 mm or less that is relatively small and even in the spark plug 1 there is concern that the heat-resisting property of the insulator 2 is lowered, the volume A of the leading end section 41 of the insulating body is set as described above, so that the heat-resisting property and contamination-resisting property can be reliably and effectively further enhanced without the operation effect of the heat-resisting property and the contamination-resisting property being damaged.

Additionally, as the embodiment, in the spark plug 1 in which the screw diameter of the screw section is M14, the volume A of the leading end section 41 of the insulating body becomes 12 $mm^3$ or more. Thus, the leading end section 41 of the insulating body has a sufficient size (thickness) and the voltage-resisting property is sufficiently maintained in the leading end section 41 of the insulating body.

Furthermore, since the volume B of the root section 42 of the insulating body becomes 83 $mm^3$ or more, the root section 42 of the insulating body has sufficient size (thickness) and the excellent voltage-resisting ability can be maintained in the root section 42 of the insulating body.

Additionally, since the maximum outer diameter of a portion that is arranged within the foot section 13 of the center electrode 5 becomes 1.7 mm or more, the heat can effectively transfer to the metal shell 3 side from the leading end section 41 of the insulating body through the center electrode 5 and the heat-resisting property can be further enhanced.

Also, since the noble metal tips 31 and 32 are welded to both of the center electrode 5 and the ground electrode 27, the were-resisting property with respect to the spark discharge can be enhanced and long lifetime can be assured. Next, in order to verify the effect in accordance to the present embodiment, samples of the spark plug that variously change the ratio of the volume A of the leading end section of the insulating body with respect to the volume B of the root section of the insulating body are prepared and the pre-ignition test is performed with respect to each of samples based on JIS D 1606.

Figure 3:
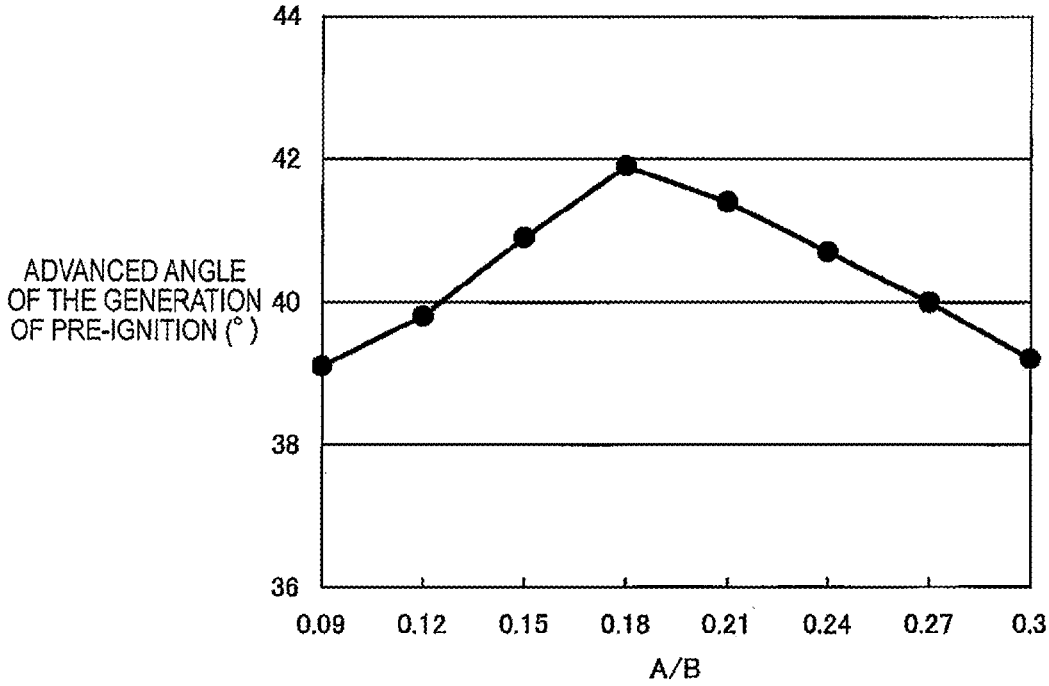
FIG. 3 is a graph illustrating a result of a pre-ignition test.

Also, a summary of the pre-ignition test is described as below. In other words, each sample is attached to 1.6 L displacement volume and 4 cylinder DOHC engine and in the state that the ignition timing is advanced as a predetermined angle from the regular ignition timing, driving is continued in two minutes per each ignition timing. Thus, the ignition timing (advanced angle of the generation of pre-ignition) on which the pre-ignition is ignited is specified based on a waveform of the current that is applied to the sample. Also, as the advanced angle of the generation of pre-ignition is large, pre-ignition is difficult to be generate in other words, it means that the heat-resisting property is excellent. In FIG. 3, the result of the pre-ignition test is illustrated. Also, the screw diameter of the screw section of each of the samples is M14 respectively.

As shown in FIG. 3, the advanced angle of the generation of pre-ignition is relatively small and it is clear that the heat-resisting property is insufficient at the sample in which A/B is less than 0.12. This is assumed that it is caused by overheating of the leading end section of the insulating body since the volume A of the leading end section of the insulating body is excessively small.

Additionally, even at the sample in which A/B is more than 0.27, the advanced angle of the generation of pre-ignition is small and the heat-resisting property is worsened. This is assumed that the heat of the leading end section of the insulating body is not sufficiently drawn toward the metal shell since the volume A of the leading end section of the insulating body is excessively large or the volume of the root section B of the insulating body is excessively small.

Meanwhile, at the sample in which $0.12 \leqq A/B \leqq 0.27$ is satisfied, the advanced angle of the generation of pre-ignition is increased to about 40° and it is clear that the heat-resisting property is excellent. This is assumed that both the volume of the leading end section of the insulating body and the volume of the root section of the insulating body is set with a good balance so that the heat of the leading end section of the insulating body can be effectively drawn toward the metal shell via the root section of the insulating body.

As described above, the volume A of the leading end section of the insulating body and the volume B of the root section of the insulating body is preferably set to satisfy $0.12 \leqq A/B \leqq 0.27$ from a view of enhancing the heat-resisting property.

Next, an evaluation test of the corruption-resisting property is performed regarding the sample of the spark plug in which A/B is variously changed based on JIS D1606.

Also, summary of the evaluation test of the corruption-resisting property is described as below. In other words, a test automobile having 1.6 L displacement volume and 4 cylinder DOHC engine is arranged in a low temperature test room (−10° C.) on a chassis dynamometer and each of the samples is assembled to the engine of the test automobile. Thus, after provisional start of the engine is performed three times, the engine is run at third speed in 35 km/h during 40 seconds, idling during 90 seconds and run again at third speed in 35 km/h during 40 seconds. After that, the engine is stopped and cooled once. Next, after provisional start of the engine is performed three times, the engine is nm at first speed in 15 km/h during 20 seconds and idling during 30 seconds, it is performed in total three times and then the engine is stopped. A series of the test pattern is regarded as one cycle and an insulation resistance value of the sample is measured after ten cycles are repeated. If the insulation resistance value of the sample is lower than 10 MΩ, the corruption-resisting property is insufficient, the evaluation is "X", while if the insulation resistance value of the sample is 10 MΩ or more, the evaluation is "O". In Table 1, the result of the test regarding the corruption-resisting property is illustrated. Also, the screw diameter of the screw section of each of the samples is M14 respectively. Also, the insulation resistance value before the test of each of the samples is larger than $10^4$ MΩ.

TABLE 1

| A/B | Evaluation |
|---|---|
| 0.09 | ○ |
| 0.12 | ○ |
| 0.15 | ○ |
| 0.18 | ○ |
| 0.21 | ○ |
| 0.24 | ○ |
| 0.27 | X |
| 0.30 | X |

As shown in Table 1, at the sample in which A/B is larger than 0.24, it is clear that the insulation resistance value is largely lowered and the contamination-resisting property is insufficient. This is assumed that the temperature of the leading end section of the insulating body is not sufficiently raised and carbon is not sufficiently burnt and eliminated since the volume A of the leading end section of the insulating body is excessively large or the like.

Meanwhile, at the sample in which A/B is 0.24 or less, it is clear that lowering of the insulation resistance value is suppressed and the contamination-resisting property is excellent. It is assumed that this is caused by sufficiently heating the leading end section of the insulating body to a range that can burn and eliminate the carbon, since the leading end section of the insulating body is relatively small or the like.

As described above, considering the result of both test results, the volume A of the leading end section of the insulating body and the volume B of the root section of the insulating body are preferably set so as to satisfy $0.12 \leqq A/B \leqq 0.24$ from a view of enhancing both of the heat-resisting property and the contamination-resisting property.

Next, after the screw diameter of the screw section is M14, M12 or M10, the samples of the spark plug in which the volume A of the leading end section of the insulating body is variously changed are prepared, five per sample and the evaluation test of the voltage-resisting is performed in an actual machine.

Also, summary of the evaluation test of the voltage-resisting in actual is described as below. In other words, after each of the samples is assembled in 0.66 L displacement volume and 4 cylinders DOHC engine, the engine is operated at an amount of rotation at 3200 rpm over 10 minutes. If a penetration is identified by discharge at the leading end section of the insulating body in any one of the five samples, the voltage-resisting property is insufficient, the evaluation is "X", while if the penetration is not identified at the leading end section of the insulating body in all of five samples, the voltage-resisting property is excellent, the evaluation is "O".

Furthermore, after the screw diameter of the screw section is M14, M12 or M10, the samples of the spark plug in which the volume of the root section B of the insulating body is variously changed are prepared, five per sample and regarding each of samples, the evaluation test of the voltage resisting is performed in oil.

Also, a summary of the evaluation test of the voltage-resisting in oil is described as below. In other words, the leading end section of each of the samples is input in a liquid insulating medium such as silicon oil of a predetermined temperature (20° C.) until the tapered section of the insulating body is dipped into oil and the liquid insulating medium fills and insulates between the insulating body and the metal shell.

After that, voltage is applied to the samples in which voltage of 35 kV is applied to the sample of screw diameter M14, 30 kV is applied to the sample of screw diameter M12 and 25 kV is applied to the sample of screw diameter M10 respectively, and the penetration is identified as being present or not by the discharge at the root section of the insulating body. Thus, if the penetration is identified at the root section of the insulating body in any one of the five samples, the voltage-resisting property is insufficient, the evaluation is "X", while if the penetration is not identified in all of five samples, the voltage-resisting property is excellent, the evaluation is "O".

The test result of the evaluation test of the durability performed in an actual machine is shown in Table 2 with the sample in which the screw diameter is M14. The test result of the evaluation test of the voltage-resisting in oil is shown in Table 3. Also, the test result of the evaluation test of the durability performed in actual machine is shown in Table 4 and the test result of the evaluation test of the voltage-resisting in oil is shown in Table 5 with the sample in which the screw diameter is M12. Furthermore, the test result of the evaluation test of the durability performed in an actual machine is shown in Table 6 and the test result of the evaluation test of the voltage-resisting in oil is shown in Table 7 with the sample in which the screw diameter is M12. Also, the number value in a bracket in each of the tables illustrates the outer diameter of the last end section of the leading end section of the insulator or the outer diameter of the most leading end section of the root section of the insulator. Also, each of the samples removes the ground electrode so as to not generate discharge at the spark discharge gap.

TABLE 2

| A ($mm^3$) | Evaluation |
|---|---|
| 8 | X |
| 10 (ϕ3.7) | X |
| 12 (ϕ3.8) | ○ |

TABLE 3

| B ($mm^3$) | evaluation |
|---|---|
| 77 | X |
| 80 (ϕ6.4) | X |
| 83 (ϕ6.5) | ○ |

TABLE 4

| A ($mm^3$) | evaluation |
|---|---|
| 4 | X |
| 5 (ϕ2.8) | X |
| 6 (ϕ3.0) | ○ |

TABLE 5

| B ($mm^3$) | evaluation |
|---|---|
| 35 | X |
| 41 (ϕ5.2) | X |
| 46 (ϕ5.6) | ○ |

TABLE 6

| A ($mm^3$) | evaluation |
|---|---|
| 2.5 | X |
| 3 (ϕ2.55) | X |
| 3.5 (ϕ2.6) | ○ |

TABLE 7

| B ($mm^3$) | evaluation |
|---|---|
| 20 | X |
| 24 (ϕ3.9) | X |
| 28 (ϕ4.2) | ○ |

As shown in Table 2 and Table 3, regarding the sample in which the screw diameter is M14, it is clear that the volume A of the leading end section of the insulator being less than 12 $mm^3$ or the volume B of the root section of the insulator being less than 83 $mm^3$ is insufficient in the voltage-resisting property. It is assumed that this is caused by the insulator being excessively thin since the volume of the insulating body is decreased.

Meanwhile, it is clear that the volume of the leading end section of the insulating body being 12 $mm^3$ or more, or the volume B of the root section of the insulating body being 83 $mm^3$ or more realizes an excellent voltage property.

Also, as shown in Table 4 and Table 5, regarding the sample in which the screw diameter is M12, it is clear that the volume A of the leading end section of the insulating body being 6 $mm^3$ or more and the volume B of the root section of the insulating body being 46 $mm^3$ or more is excellent in the voltage-resisting property. As shown in Table 6 and Table 7, regarding the sample in which the screw diameter is M10, it is clear that the volume A of the leading end section of the insulating body being 3.5 $mm^3$ or more and the volume B of the root section of the insulating body being 28 $mm^3$ or more is excellent in the voltage-resisting property.

As described above, considering the test results, it is preferable that the volume of the leading end section of the insulating body is 12 $mm^3$ or more and the volume B of the root section of the insulating body is 83 $mm^3$ or more in the spark plug in which the screw diameter of the screw section is M14 from a view of enhancing the voltage-resisting property. Also, it is preferable that the volume of the leading end section of the insulating body is 6 $mm^3$ or more and the volume B of the root section of the insulating body is 46 $mm^3$ or more in the spark plug in which the screw diameter of the screw section is M12 and it is preferable that the volume of the leading end section of the insulating body is 3.5 $mm^3$ or more and the volume B of the root section of the insulating body is 28 $mm^3$ or more in the spark plug in which the screw diameter of the screw section is M10.

Also, the upper limit of the volume A of the leading end section of the insulating body or the volume B of the root section of the insulating body is not specifically limited from an aspect that an excellent voltage-resisting property is realized, however the volume B of the root section of the insulating body is preferably 113 $mm^3$ or less in the spark plug of the screw diameter M14, the volume B of the root section of the insulating body is preferably 54 $mm^3$ or less in the spark plug of the screw diameter M12 and the volume B of the root section of the insulating body is preferably 37 $mm^3$ or less in the spark plug of the screw diameter M10 when considering the size of the metal shell (specifically, the size of the bore which the insulator is passed through).

Figure 4:
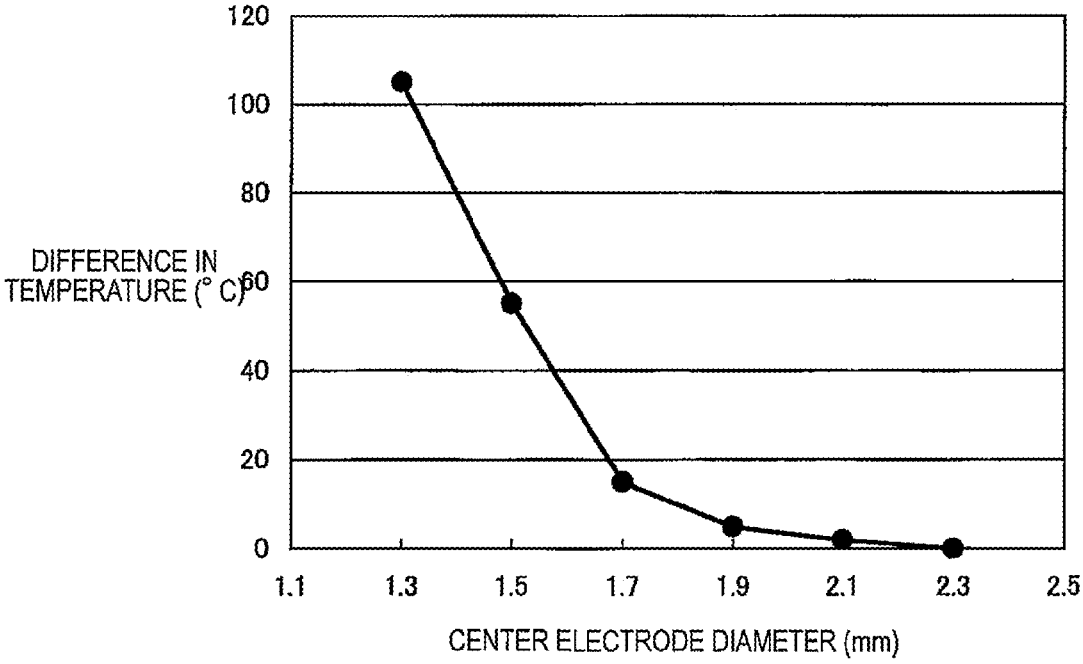
FIG. 4 is a graph illustrating a relation between a center electrode diameter and a difference in temperature.

Next, after the screw diameter of the screw section is M14, the samples of the spark plug in which the inner diameter (the center electrode diameter) of the portion that is arranged within the foot section in the center electrode is variously changed are prepared. Each of the samples is assembled in 1.6 L displacement volume and 4 cylinder DOHC engine and then the engine is operated in a predetermined operation condition. The temperature of the leading end section of the center electrode is measured when the engine is operated and the difference in temperature between the temperature and a temperature (a reference temperature) of which the diameter of the center electrode is 2.3 mm when heating in the same condition as the sample. FIG. 4 shows a graph illustrating the relation between the center electrode diameter and the difference in temperature.

As shown in FIG. 4, it is clear that in the sample in which the diameter of the center electrode is less than 1.7 mm, the difference in temperature rapidly increases and the heat drawing of the center electrode deteriorates. Accordingly, regarding the spark plug in which the screw diameter of the screw section is M14, the diameter of the center electrode is preferably 1.7 mm or more from a view of enhancing the heat-resisting property.

However, the widening of the diameter of the center electrode leads to a relatively thinner insulator. Accordingly, regarding the spark plug in which the screw diameter of the screw section is M14 the diameter of the center electrode is preferably 3.0 mm or less from a view of sufficiently enhancing the voltage-resisting property.

Also, the same test is performed in the samples of the spark plug in which the screw diameter of the screw section is M12 or M10. It is clear that when the diameter of the center electrode is less than 1.5 mm regarding the sample in which the screw diameter is M12 and when the diameter of the center electrode is less than 1.3 mm regarding the sample in which the screw diameter is M10, the difference in temperature rapidly increases respectively.

Accordingly, regarding the spark plug in which the screw diameter is M12, the diameter of the center electrode is preferably 15 mm or more and the spark plug in which the screw diameter is M10, the diameter of the center electrode is preferably 1.3 mm or more from a view of enhancing the heat-resisting property.

However, regarding the spark plug in which the screw diameter is M12, the diameter of the center electrode is preferably 2.6 mm or less and the spark plug in which the screw diameter is M10, the diameter of the center electrode is preferably 2.1 mm or less from a view of sufficiently securing the thinness of the insulating body and realizing the sufficient voltage-resisting property.

Also, the invention is not limited to the above-described embodiments and for example, the examples described below may be applied. It is a matter of course that applications and modifications other than the examples described below may be applied.

Figure 5:
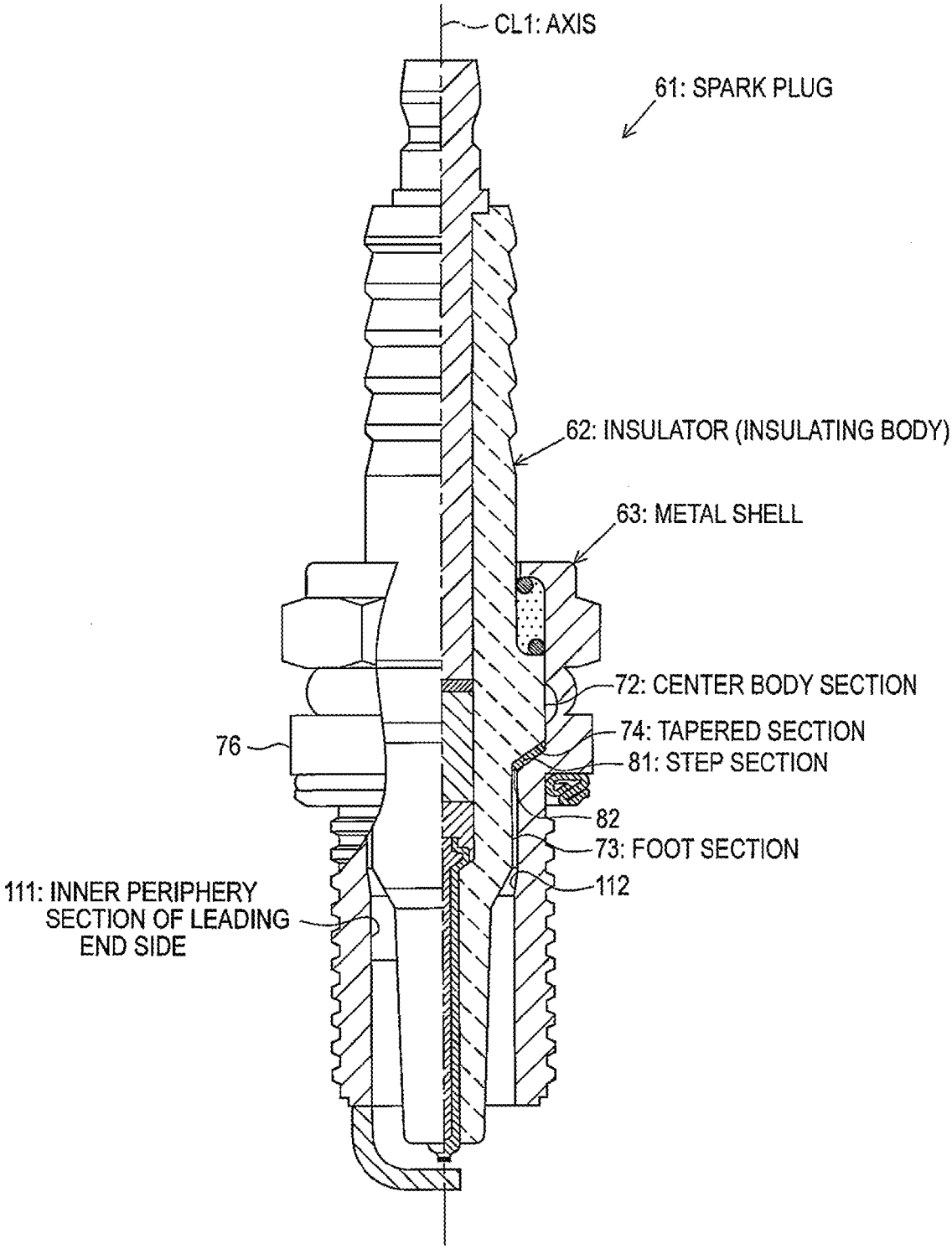
FIG. 5 is a plan view as a portion being broken out illustrating a configuration of a spark plug according to other embodiment.
Figure 6:
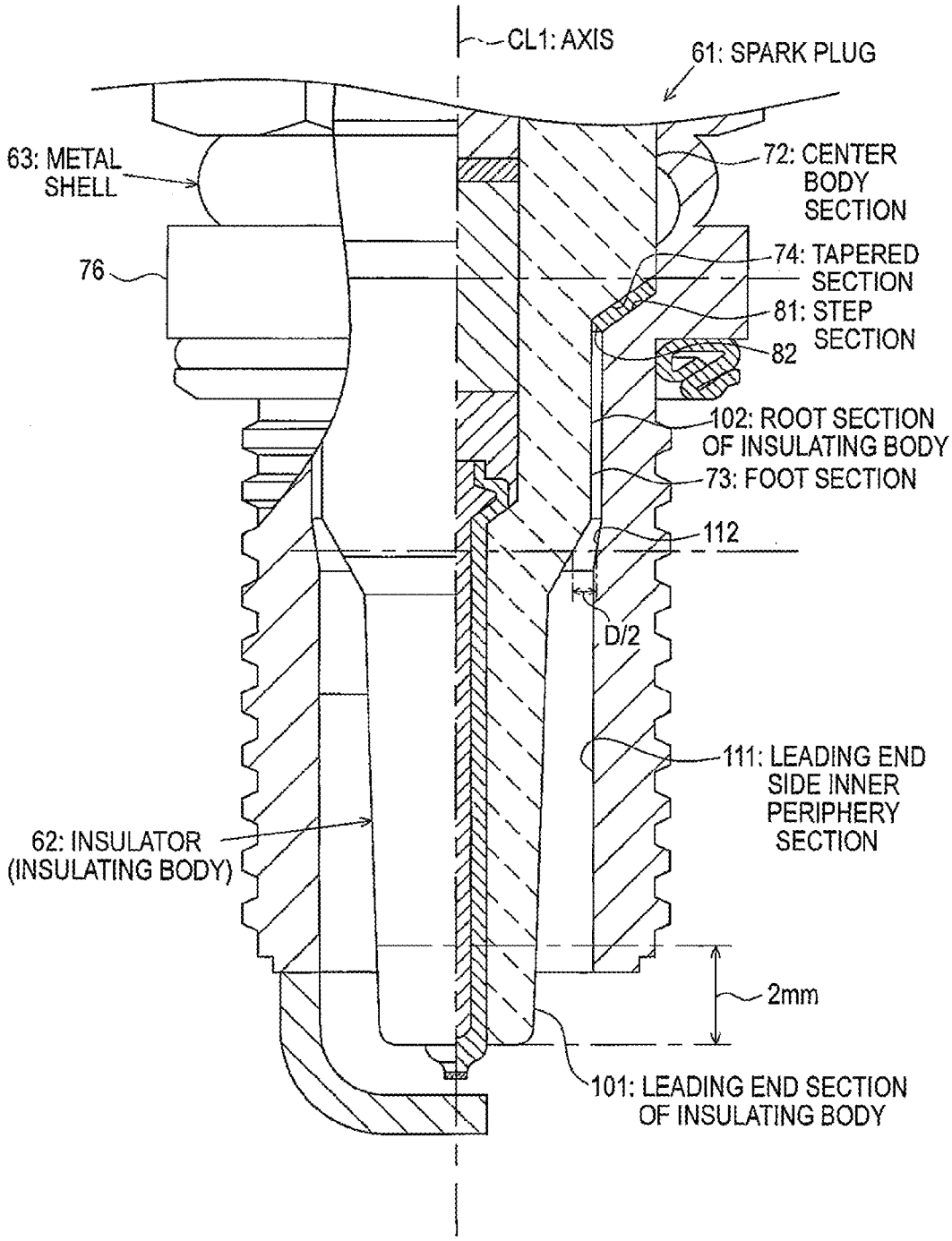
FIG. 6 is an enlarged plan view as a portion being broken out illustrating a configuration of a leading end section of a spark plug according to other embodiment.

(a) The configuration of the spark plug that may apply the technical thinking of the invention is not limited to the above-described embodiments. For example, as shown in FIGS. 5 and 6, the technical thought of the invention may also be applied to a spark plug 61 that is configured such that a tapered section 74 that is positioned between a foot section 73 and a middle body section 72 of an insulator 62 is engaged to a step section 81 that is positioned in the same position or further to the rear end side of the tapered section 74 along the axis CL1 direction with respect to a seat section 76 of a metal shell 63 through a sheet packing 82. The spark plug 61 also has a diameter-decreased section 112 in which a leading end side inner periphery section 111 is gradually decreased in diameter toward the leading end side. Even in the spark plug 61, regarding the volume A of an insulating body leading end section 101 that is positioned to 2 mm toward the leading end side from the leading end and the volume B of 102 that is positioned in the leading end side from the rear end of the portion that is engaged to a step section 81 in the tapered section 74, and that is a portion in which the diameter difference D between the leading end side inner periphery section 111 and its outer periphery portion leading end is 1.5 mm or less (in other words, $D/2 \leqq 0.75$ mm), the volume A and the volume B are set so as to satisfy $0.12 \leqq A/B \leqq 0.24$ so that both the heat-resisting property and the were resisting property can be enhanced.

(b) In the above-described embodiments, the tapered section 14 is indirectly engaged to the step section 21 through the sheet packing 22, however the sheet packing 22 may be omitted and the tapered section 14 can be directly engaged to the step section 21.

(c) In the above-described embodiments, the noble metal tips 31 and 32 are arranged at the leading end section of the ground electrode 27 or the center electrode 5, however the invention may be configured such that either or both the noble metal tips 31 and 32 can be omitted. Also, in a case where one or both of the noble metal tips 31 and 32 are omitted, the spark discharge gap 33 is formed between the leading end section of the center electrode 5 and the leading end section of the ground electrode 27. In a case where one noble metal tip 31 (the noble metal tip 32) of the center electrode 5 (the ground electrode 27) is omitted, the spark discharge gap 33 is formed between the leading end section of one side of the center electrode 5 (the ground electrode 27) and the noble metal tip 32 (the noble metal tip 31) that is provided in the other the ground electrode 27 (the center electrode 5). (d) In the above-described embodiments, the screw diameter of the screw section 15 becomes M14 or less, however the screw diameter of the screw section 15 is not specifically limited.

(e) In the above-described embodiments, the invention is embodied in a case where the ground electrode 27 or the like is welded to the leading end section 26 of the metal shell 3, however the invention may also be applied in a case where a portion (or, a portion of the leading end metal fitting that is welded to the metal shell beforehand) of the metal shell is cut and then the ground electrode is formed (for example, JP-A-2006-236906).

(f) In the above-described embodiments, the tool engaging section 19 is a hexagonal shape in cross section, however the shape of the tool engaging section 19 is not limited to this shape. For example, Bi-HEX shape (deformed twelve angles) [ISO22977: 2005(E)] or the like may be applied.

REFERENCE SIGNS LIST

1,61 . . . spark plug 2,62 . . . insulator (insulating body) 3,63 . . . metal shell 4 . . . axial hole 5 . . . center electrode 12,72 . . . center body section 13,73 . . . foot section 14,74 . . . tapered section 15 . . . screw section 21,81 . . . step section 26 . . . leading end section (of metal shell) 27 . . . ground electrode 31,32 . . . noble metal tip 33 . . . spark discharge gap (gap) 41,101 . . . leading end section of insulating body 42,102 . . . root section of insulating body 51,111 . . . inner periphery section of leading end side CL1 . . . axis

The invention claimed is:

1. A spark plug comprising:

a rod shape center electrode;

a cylindrical shape insulating body that has an axial hole extending in an axis direction and includes the center electrode at a leading end side of the axial hole; and a cylindrical shape metal shell that surrounds and holds a periphery of the insulating body in a state that a leading end section of the insulating body is extended further than its leading end surface, wherein the insulating body includes:

a foot section that is positioned at the leading end section;

a tapered section that is extended toward a rear end side from a rear end of the foot section and has a diameter that is widened toward the rear end side; and a middle body section that is extended toward the rear end side from a rear end of the tapered section and has a diameter that is larger than the foot section, wherein a step section and a leading end side inner periphery section that is positioned at a leading end side of the step section are formed in the inner periphery of the metal shell, wherein the insulating body is fixed at the metal shell in a state that the tapered section is directly or indirectly engaged with respect to the step section, wherein a maximum outer diameter of a portion, which is arranged within the foot section, of the center electrode is 3.0 mm or less, wherein assuming that A ($mm^3$) is a volume of a portion of 2 mm of the insulating body from a leading end of the insulating body toward a rear end side along the axis direction and B ($mm^3$) is a volume of a portion of the insulating body from a rear end of the portion of the tapered section which is engaged to the step section to a leading end side and in which a diameter difference between the leading end side inner periphery section and its outer periphery portion is 1.5 mm or less, $0.12 \leqq A/B \leqq 0.24$ is satisfied.

2. The spark plug according to claim 1, wherein the metal shell has a screw section that is screwed into an attachment hole of a combustion apparatus, a screw diameter of the screw section is M14, and $12\ mm^3 \leqq A$ and $83\ mm^3 \leqq B \leqq 113\ mm^3$ are satisfied.

3. The spark plug according to claim 2, wherein the maximum outer diameter of the portion, which is arranged within the foot section, of the center electrode is 1.7 mm or more.

4. The spark plug according to claim 1, wherein the metal shell has a screw section that is screwed into an attachment hole of a combustion apparatus, a screw diameter of the screw section is M12, and $6\ mm^3 \leqq A$ and $35\ mm^3 \leqq B \leqq 54\ mm^3$ are satisfied.

5. The spark plug according to claim 4, wherein the maximum outer diameter of the portion, which is arranged within the foot section, of the center electrode is 1.5 mm or more to 2.6 mm or less.

6. The spark plug according to claim 1, wherein the metal shell has a screw section that is screwed into an attachment hole of a combustion apparatus, a screw diameter of the screw section is M10, and $3.5\ mm^3 \leqq A$ and $2\ mm^3 \leqq B \leqq 37\ mm^3$ are satisfied.

7. The spark plug according to claim 6, wherein the maximum outer diameter of the portion, which is arranged within the foot section, of the center electrode is 1.3 mm or more to 2.1 mm or less.

8. The spark plug according to claim 1, further comprising, a ground electrode that is extended from the leading end section of the metal shell and a leading end section thereof forms a gap with the leading end section of the center electrode, wherein a noble metal tip is arranged in at least one of the center electrode and the ground electrode.

* * * * *